US007628582B2

(12) United States Patent
Kanai et al.

(10) Patent No.: US 7,628,582 B2
(45) Date of Patent: Dec. 8, 2009

(54) AIR BLOWER

(75) Inventors: Takashi Kanai, Iruma (JP); Hiroki Matsushita, Iruma (JP)

(73) Assignee: Nidec Copal Electronics Corporation, Tokyo (JP)

( * ) Notice: Subject to any disclaimer, the term of this patent is extended or adjusted under 35 U.S.C. 154(b) by 3 days.

(21) Appl. No.: 10/589,302

(22) PCT Filed: Jun. 23, 2005

(86) PCT No.: PCT/JP2005/011527

§ 371 (c)(1),
(2), (4) Date: Aug. 11, 2006

(87) PCT Pub. No.: WO2006/087829

PCT Pub. Date: Aug. 24, 2006

(65) Prior Publication Data

US 2007/0297922 A1 Dec. 27, 2007

(51) Int. Cl.
*F04D 29/42* (2006.01)

(52) U.S. Cl. ..... 415/206; 416/186 R; 416/189; 417/423.7; 417/423.12

(58) Field of Classification Search ..... 416/183, 416/185, 186 R, 188, 194, 195, 196 A, 196 R, 416/223 B, 189; 417/423.7, 423.12; 310/90; 415/206, 224
See application file for complete search history.

(56) References Cited

U.S. PATENT DOCUMENTS 5,328,332 A * 7/1994 Chiang ..... 416/186 R
6,146,094 A * 11/2000 Obana et al. ..... 415/200
6,236,129 B1 * 5/2001 Yamashita ..... 310/90
7,435,051 B2 * 10/2008 Obinelo et al. ..... 415/228

* cited by examiner

*Primary Examiner*—Ninh H Nguyen
(74) *Attorney, Agent, or Firm*—Jordan and Hamburg LLP

(57) ABSTRACT

The air blower includes a case body having an air suction mouth and an outlet formed at a peripheral wall thereof; a motor which is installed into the case body, having a fluid dynamic bearing; and an impeller which is fixed to a rotation member of the motor, having a plurality of blade support plates, which is formed in the shape of a ring, capable of suctioning air from the air suction mouth by rotating and discharging from the outlet, provided at an upper and lower surfaces thereof, equalizing the difference in pressure between the upper and lower surfaces thereof. Therefore, it can rotate at a high speed, blow in under high pressure at large air volume even though it has small size and is economical and long-lived.

4 Claims, 10 Drawing Sheets

AIR BLOWER

TECHNICAL FIELD

The present invention relates generally to an air blower including a sirocco-fan, turbo blower and the like.

BACKGROUND ART

The conventional air blower supports rotatably the shaft of the impeller via the ball bearing, sleeve bearing, bearing, oil retaining bearing.

It does not allow the air blower with such bearing to rotate at high speed so that it is difficult to downsize and it has a short life span because it needs certain large size of the impeller.

In addition, for the air blower which is attached an impeller to a motor with a core, eddy-current loss and hysteresis loss of the core become large as it rotates on high speed.

Accordingly, it is an object of the present invention to provide an air blower which can rotate at a high speed, blow in under high pressure at large air volume even though it is small size and is economical and long-lived.

In addition, it is another object of the present invention to provide an air blower which can control to move an impeller to a thrust direction extremely with blowing and protect an impeller to hit a case body. Also it is still another object of the present invention to provide an air blower which can reduce oscillation and noise.

The present invention is understood to encompass embodiments which include all or only a portion of the above objects, features and advantages which, unless recited in claims defining the invention, are understood not to limit interpretation of such claims. The above, and other objects, features and advantages of the present invention will become apparent from the following description read in conjunction with the accompanying drawings, in which like reference numerals designate the same elements.

It is to be expressly understood, however, that the drawings are for the purpose of illustration and description only, and are not intended as a definition of the limits of the invention.

SUMMARY OF THE INVENTION

Accordingly, the air blower includes a case body having an air suction mouth and an outlet formed at a peripheral wall thereof, a motor which is installed into the case body, having a fluid dynamic bearing; and an impeller which is fixed to a rotation member of the motor, having a plurality of blade support plates, which is formed in the shape of a ring, capable of suctioning air from the air suction mouth by rotating and discharging from the outlet, provided at an upper and lower surfaces thereof, equalizing the difference in pressure between the upper and lower surfaces thereof.

DESCRIPTION OF THE PREFERRED EMBODIMENT

Figure 1:
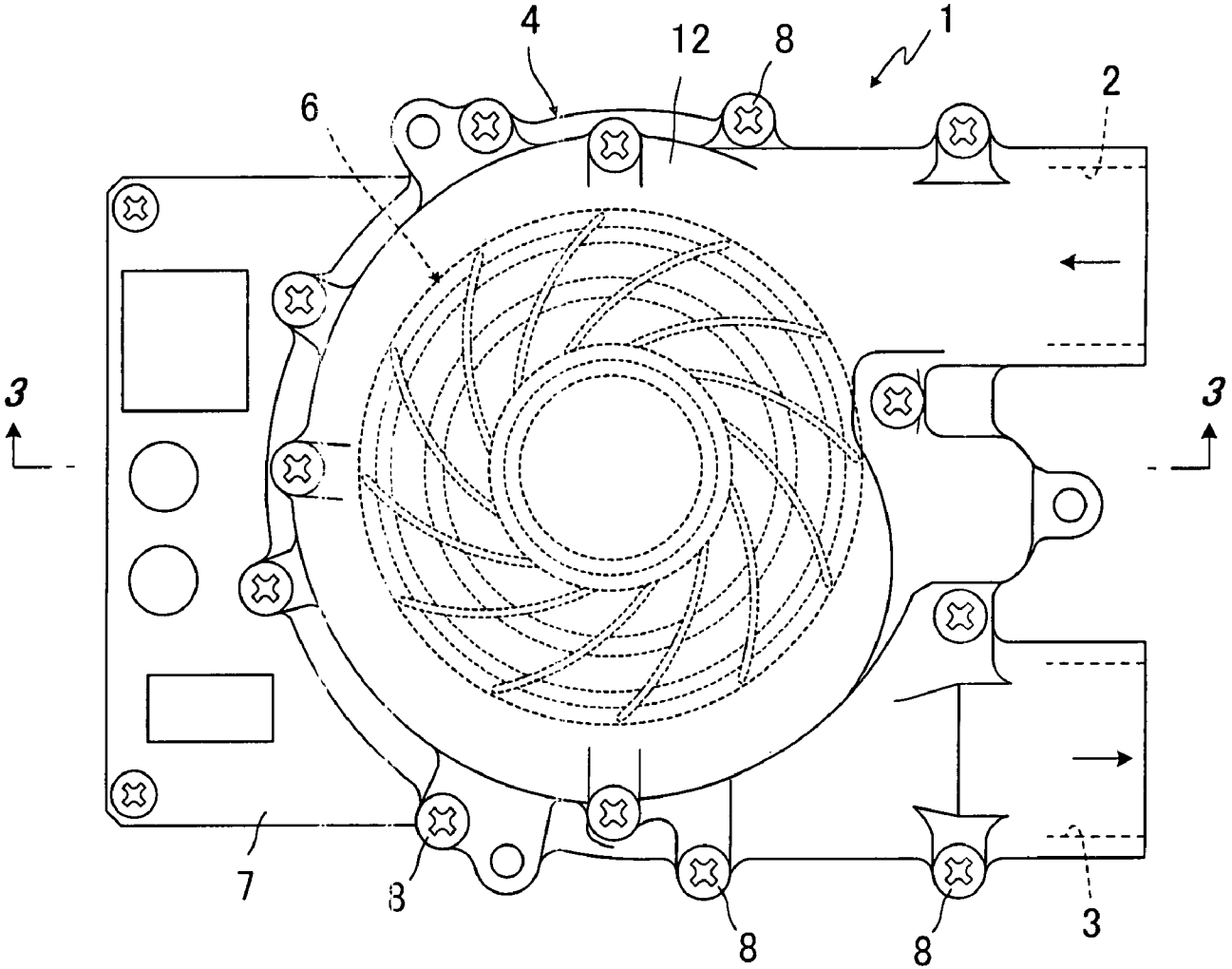
FIG. 1 is a plan view showing a first embodiment of the present invention.
Figure 2:
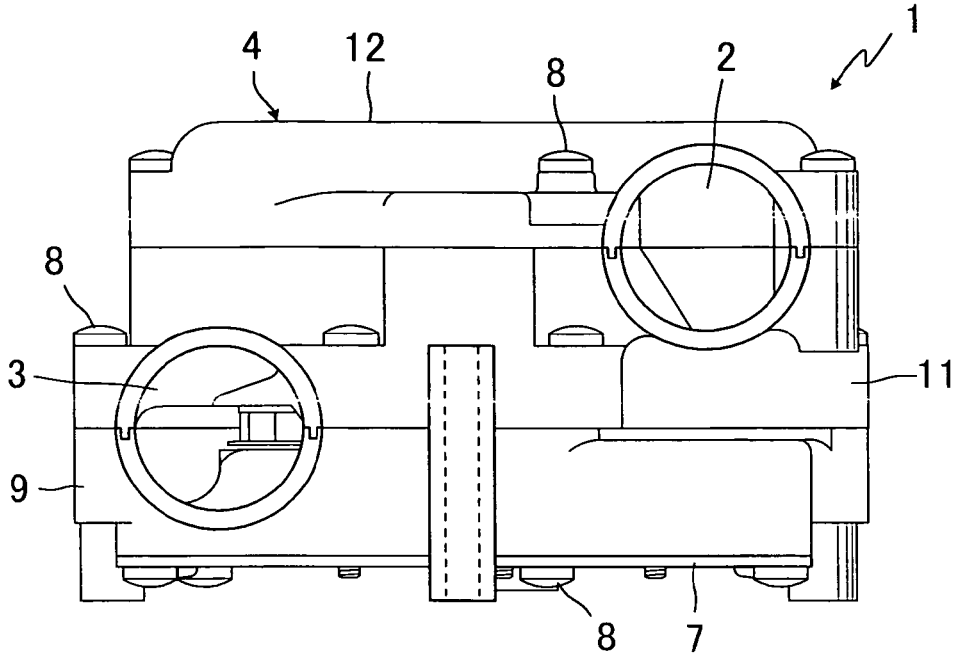
FIG. 2 is a front view showing a first embodiment of the present invention.
Figure 3:
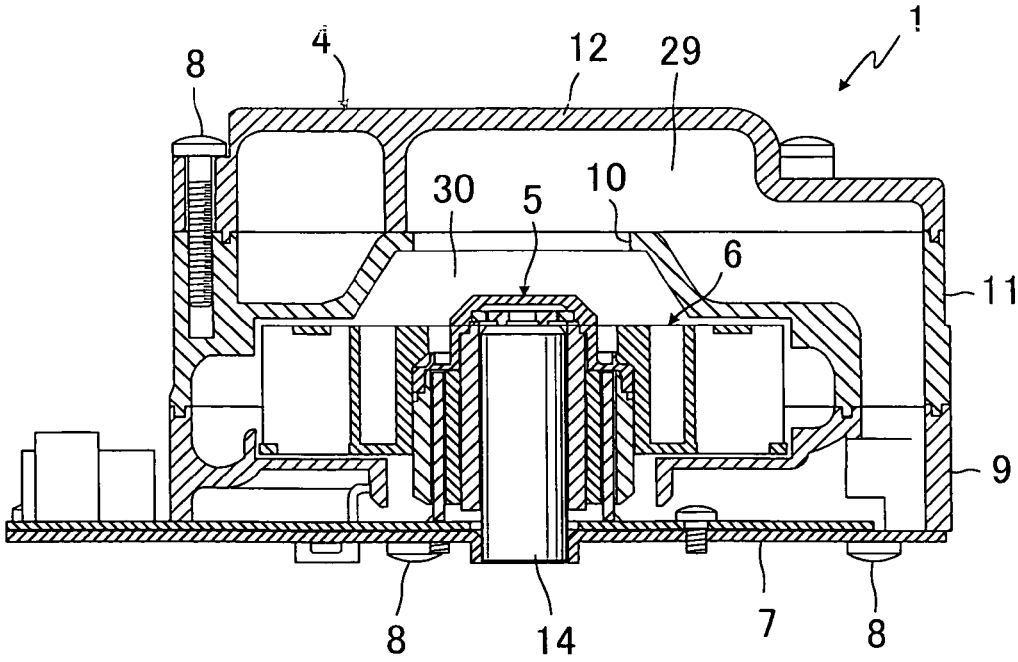
FIG. 3 is a cross sectional view taken along a line 3-3 in FIG. 1.
Figure 4:
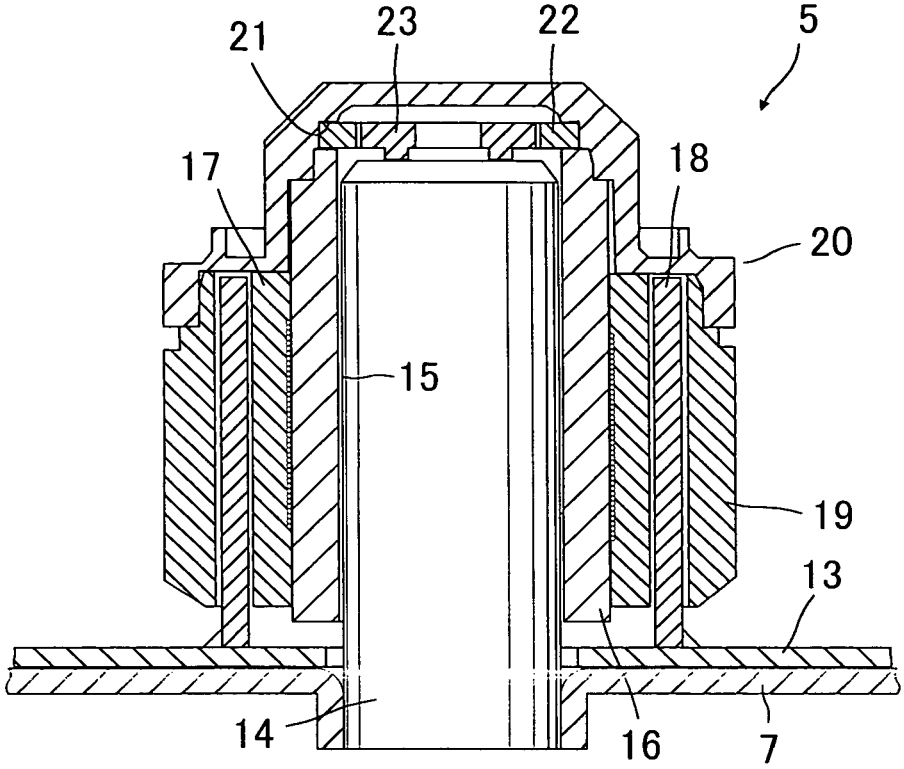
FIG. 4 is a cross sectional view of a motor showing a first embodiment of the present invention.

Preferred embodiments of the present invention are described in more detail below referring to the accompanying drawings.

An understanding of the present invention may be best gained by reference FIGS. 1 to 8.

The reference numeral 1 is an air blower of the present invention which is comprised of a case body 4 provided an air suction mouth 2 and an outlet 3; a motor 5 installed into the case body 4, having a fluid dynamic bearing which is driven at a high speed; and an impeller which is fixed to a rotation member of the motor 5 so as to locate at an outer circumferential part of the motor 5, suctioning air from the air suction mouth 2 by rotating and discharging from the outlet 3.

The case body 4 is further comprised of a base plate 7; a lower case 9 which is fixed to the base plate 7 by a plurality of screws 8, covering an outer circumferential part of the motor 5 and a lower part of the impeller 6; an upper case 11 which is fixed to an upper part of the lower case 9 by the screws 8, having a air introduce mouth 10 which is formed at a center portion thereof and covering the upper part of the impeller 6; the outlet 3 which is formed at the outer circumferential parts of the upper case 11 and lower case 9; a covering case 12 which is fixed to an upper part of the upper case 11 by the screws 8; and the air suction mouth 2 which is formed at the outer circumferential parts of the covering case 12 and upper case 11.

The motor 5 is further comprised of a board 13 fixed to an upper surface of the base plate 7 of the case body 4, provided a motor drive circuit (not shown); a shaft 14 which is fixed to project upward from the board 13; a sleeve 16 which is positioned at an outer circumferential part of the shaft 14 via a minute space 15; a rotor 17 which is provided at an outer circumferential part of the sleeve 16, putting permanent magnets; a coreless waveform continuation coil 18 which is attached to the board 13 so as to positioned at an outer circumferential part of the rotor 17; a back yoke 19 which is provided so as to position at an outer circumferential part of the coil 18; a thrust magnet 22, which is formed in the shape of a ring, fixed to a concave part 21 which is formed at the upper part of the hub 20 which covers the shaft 14, supporting the sleeve 16, rotor 17 and back yoke 19, having a hub 20 as the rotation member which covers an upper part of the shaft 14 and the outer circumferential part of the back yoke 19; and a thrust magnet 23 which is fixed to the upper part of the shaft 14 so as to face to the thrust magnet 22.

Figure 5:
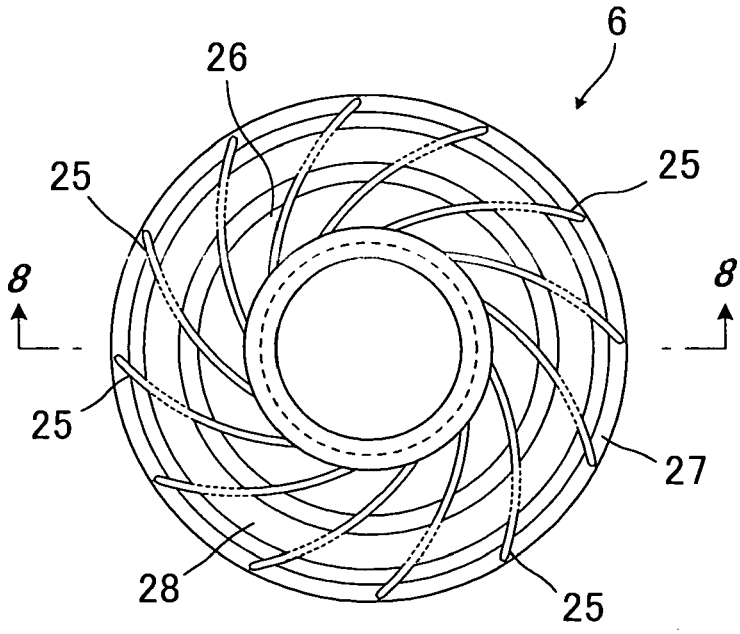
FIG. 5 is a plan view of an impeller showing a first embodiment of the present invention.
Figure 6:
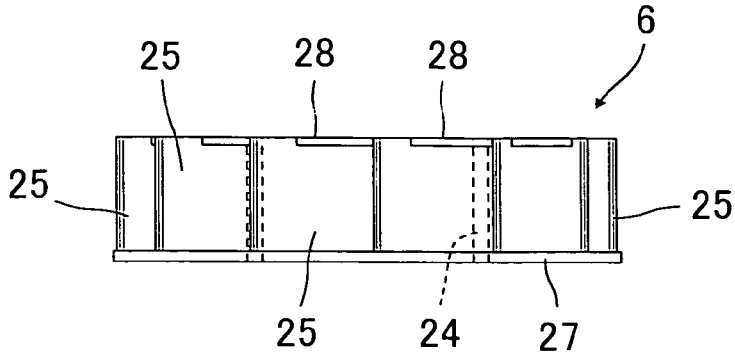
FIG. 6 is a front view of an impeller showing a first embodiment of the present invention.
Figure 7:
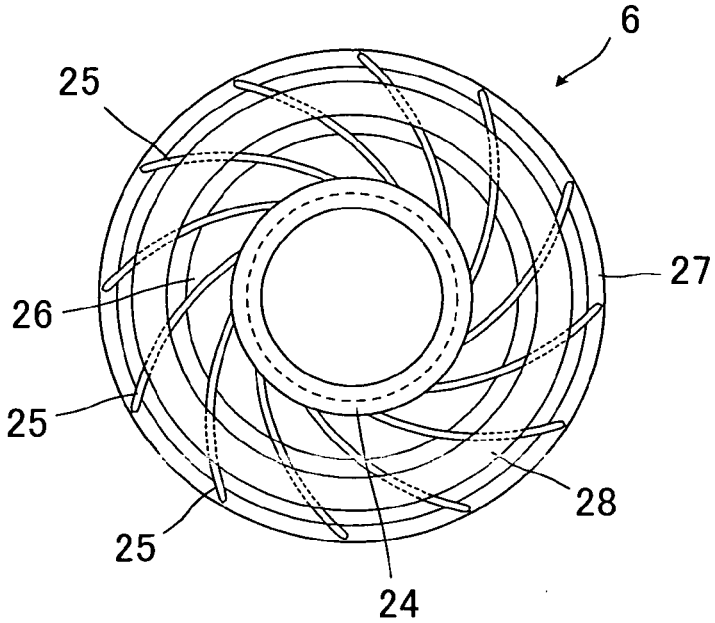
FIG. 7 is a bottom view of an impeller showing a first embodiment of the present invention.
Figure 8:
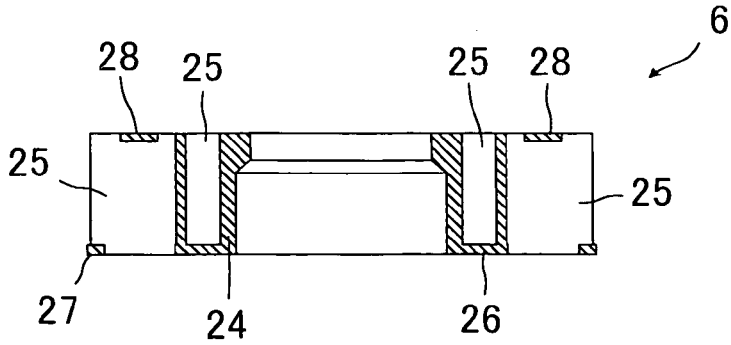
FIG. 8 is a cross sectional view taken along a line 8-8 in FIG. 5.
Figure 9:
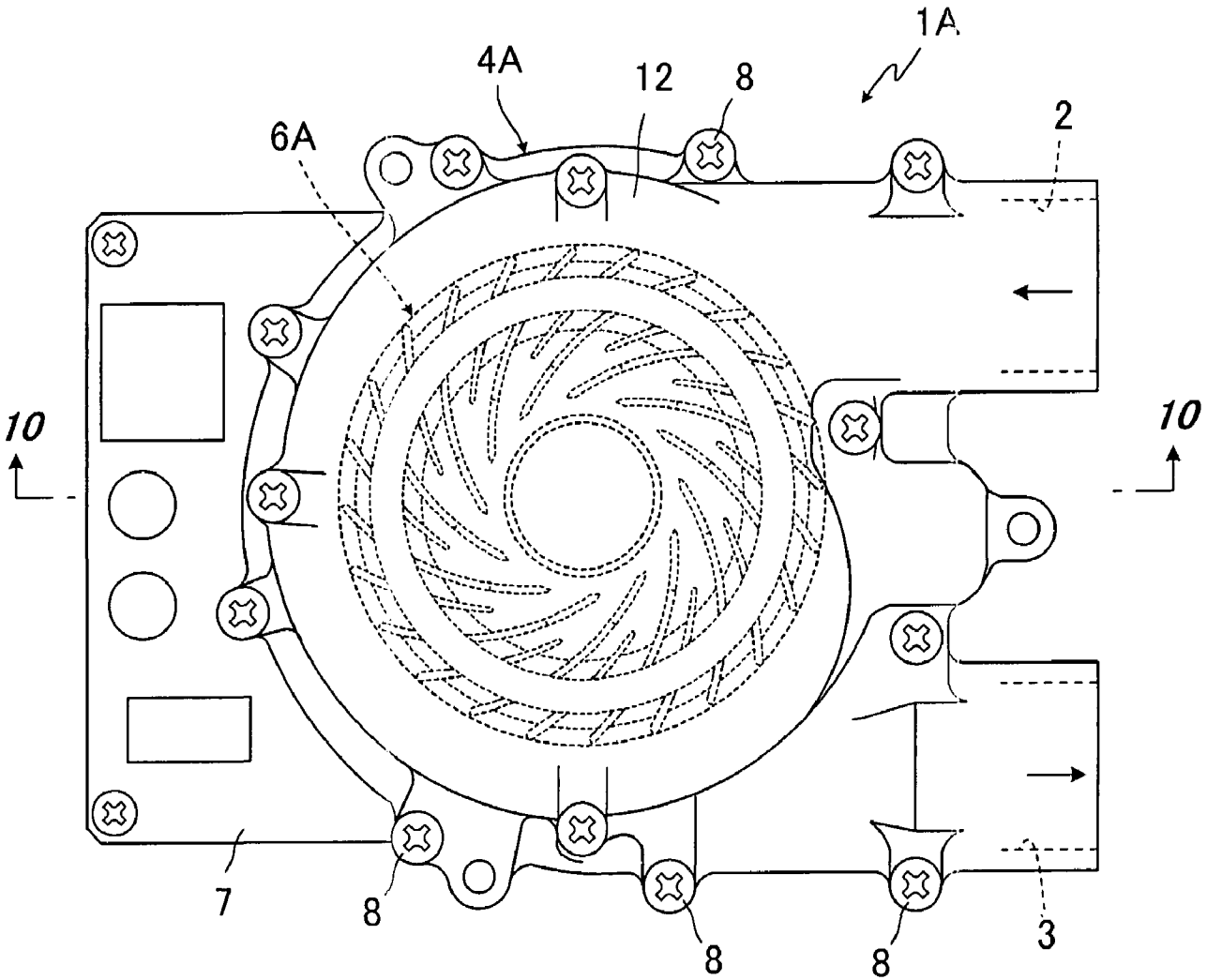
FIG. 9 is a plan view showing a second embodiment of the present invention.
Figure 10:
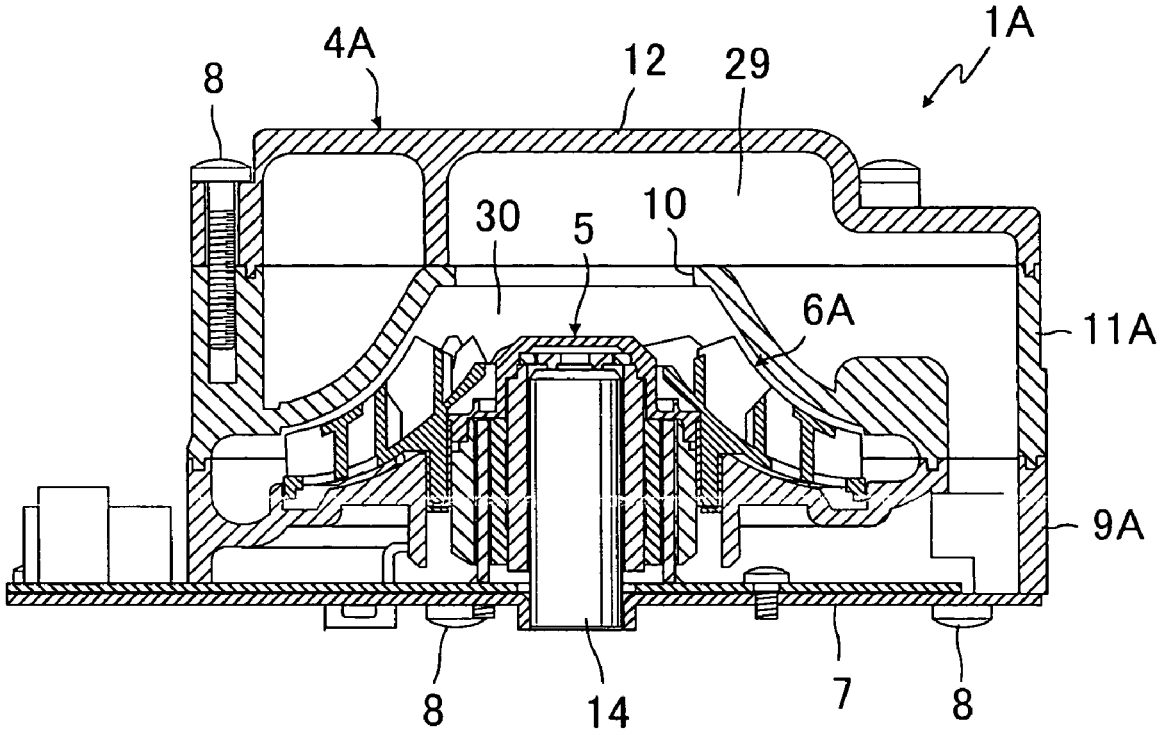
FIG. 10 is a cross sectional view taken along a line 10-10 in FIG. 9.
Figure 11:
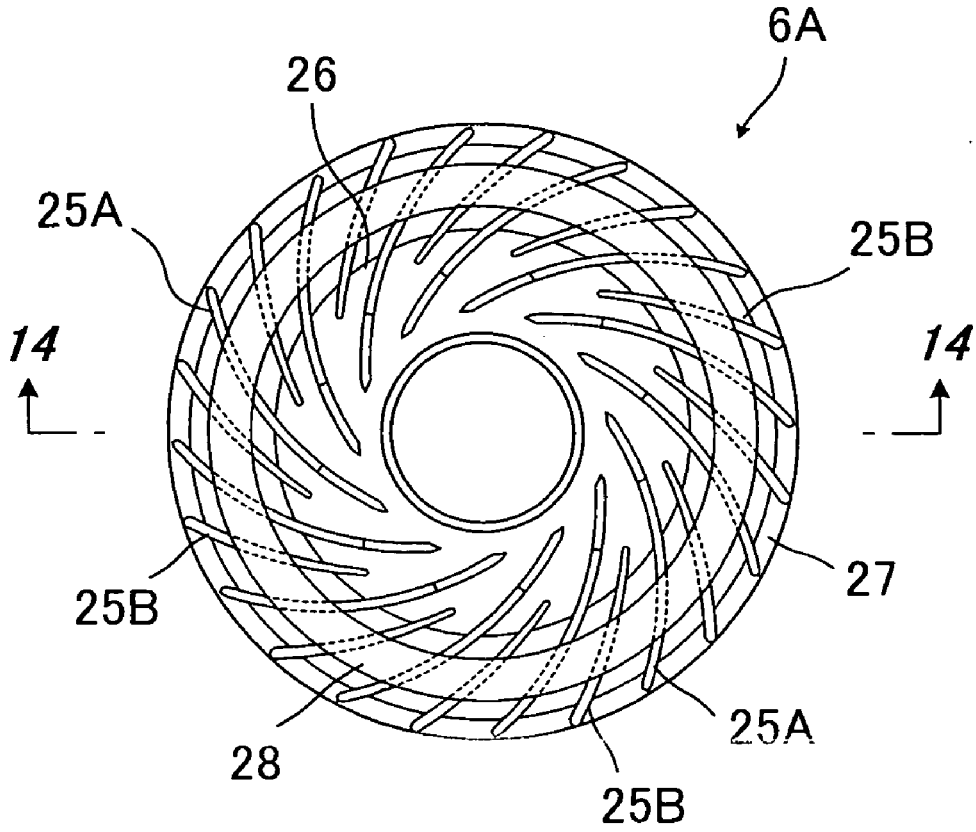
FIG. 11 is a plan view of an impeller showing a second embodiment of the present invention.
Figure 12:
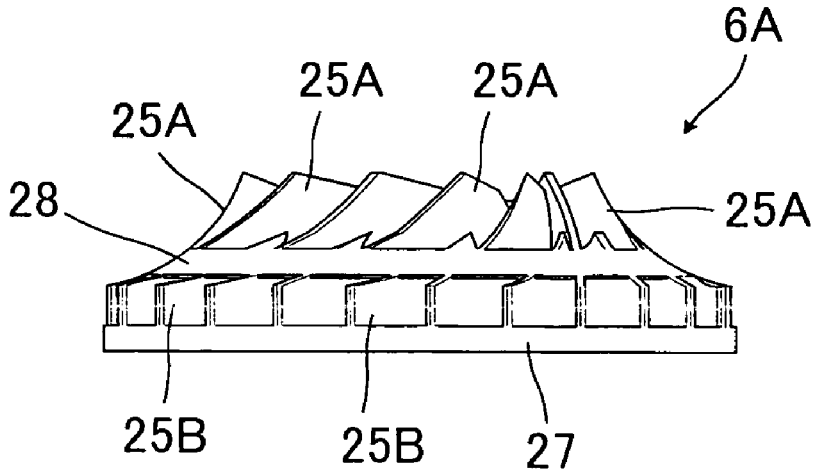
FIG. 12 is a front view of an impeller showing a second embodiment of the present invention.
Figure 13:
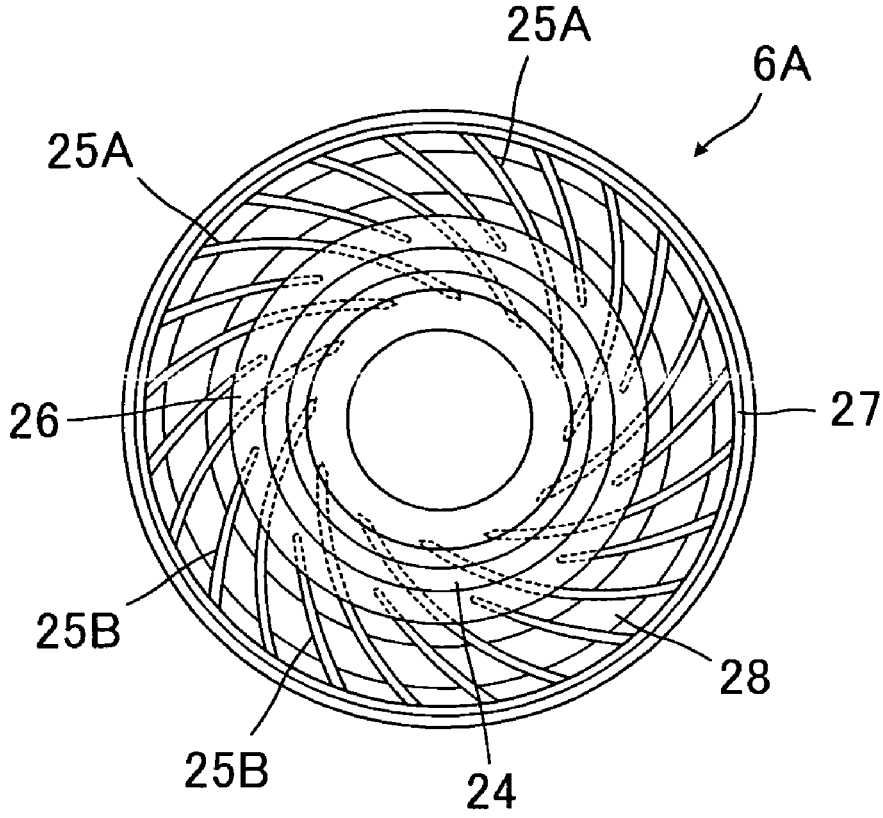
FIG. 13 is a bottom view of an impeller showing a second embodiment of the present invention.
Figure 14:
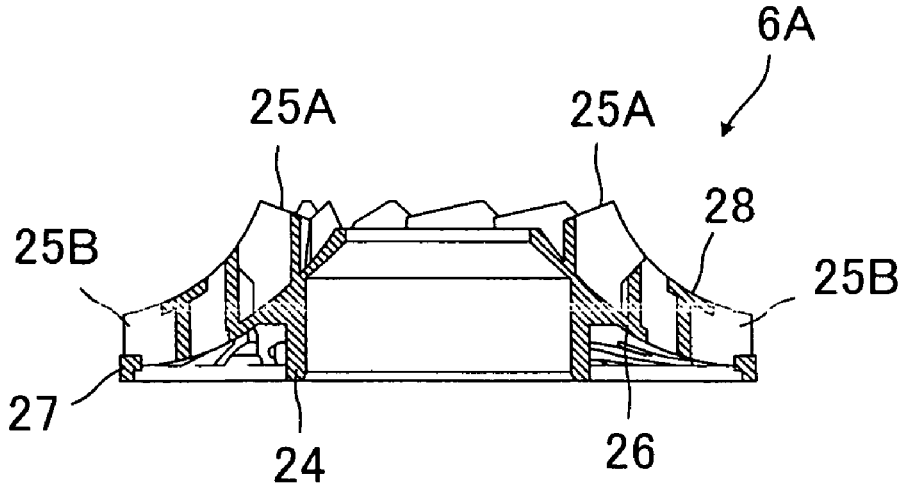
FIG. 14 is a cross sectional view taken along a line 14-14 in FIG. 11.

As shown in FIGS. 5 to 7, the impeller is further comprised of a boss 24 which joints the hub 20 as the rotation member of the motor 5; a plurality of blades 25 which are formed integrally to the boss 24 at a predetermined intervals; blade support plates 26, 27, which are formed in the shape of a ring, provided integrally at the parts adjacent inside and outside at the lower part of the blades so as to equalize the difference in pressure between the upper and lower portions of the blades 25; and a blade support plate 28, which is formed in the shape of a ring, which is formed integrally at the upper part of the blades 25 and a part between the plates 26 and 27 so as to form by mold without the sliding core.

For the air blower 1, the impeller 6 rotates at a high speed after the motor 5 is driven. After that, the air suction mouth 2 of the case body 4 sucks air therein, and the sucked air is introduced into an impeller room 30 of the upper case 11 and lower case 9 through air introduce channel 29 of the covering case 12 and upper case 11 and air introduce mouth 10 of the upper case 11. Then, air with high pressure is discharged from the outlet 3. Therefore, it can blow in under high pressure at large air volume even though it has small size.

Since the motor 5 has the rotor 17 which is arranged the permanent magnet with revolving structure at the outer circumferential part of the sleeve 16 which is positioned at the outer circumferential part of the shaft 14 via the minute space 15 and the coreless waveform continuation coil 18, there is absolutely no harmful power which is added to the shaft 14 and sleeve 16 from the magnetic circuit generating the revolving force.

For this reason, it takes bearing rigidity to just support empty weight of the rotor 17 basically.

In addition, since the difference in pressure between the upper and lower portions of the impeller 6 equalizes by the blade support plates 26, 27 and 28, the trouble that the impeller 6 hits the inner wall surface of upper and lower cases 11 and 9 and the like can be resolved because the impeller 6 moves upward and downward.

In this way, the motor 5 with the fluid dynamic bearing is used in the present invention so that it can blow in under high pressure at large air volume even though it has small size and is economical and long-lived. In addition, it can control to move the impeller to a thrust direction extremely and protect an impeller 6 to hit a case body 4.

In addition, it can reduce eddy-current loss and hysteresis loss because the motor is used the coreless motor type.

Other embodiments of the present invention will now be described referring to FIGS. 9 to 17. Through the drawings of the embodiments, like components are denoted by like numerals as of the first embodiment and will not be further explained in great detail.

A second embodiment of the present invention is shown in FIGS. 9 to 14 and is distinguished from the first embodiment by the fact that the impeller 6 is replaced from another impeller 6A which has a plurality of blades 25A and 25B, having declines towards outside from the center portion of the blades 25A and forming so as to go low towards outside at height, and the blades 25B with no center parts of the blades; and the case body 4 is replaced from another case body 4A including a lower case 9A and upper case 11A which form so as to cover the impeller 6A as shown in FIGS. 10 to 14. An air blower 1A with the impeller 6A and case body 4A according to the second embodiment has similar advantages to that according to the first embodiment.

Figure 15:
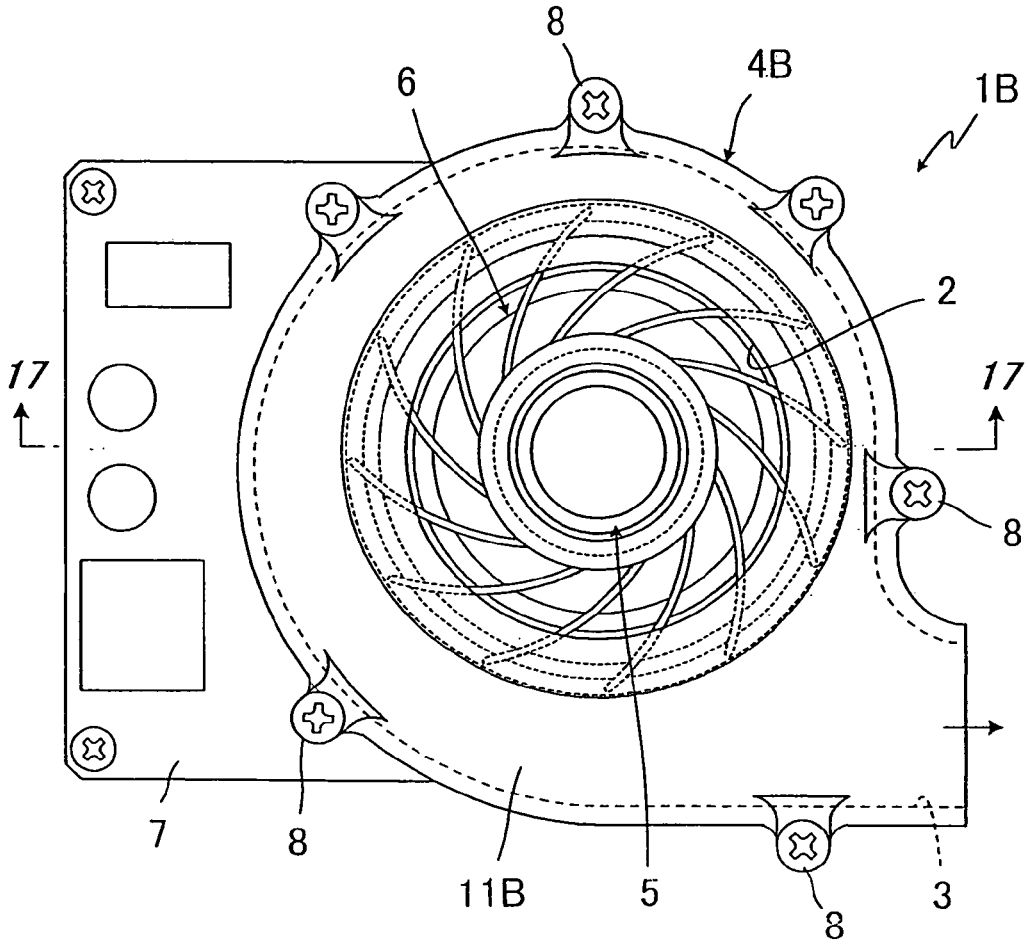
FIG. 15 is a plan view showing a third embodiment of the present invention.
Figure 16:
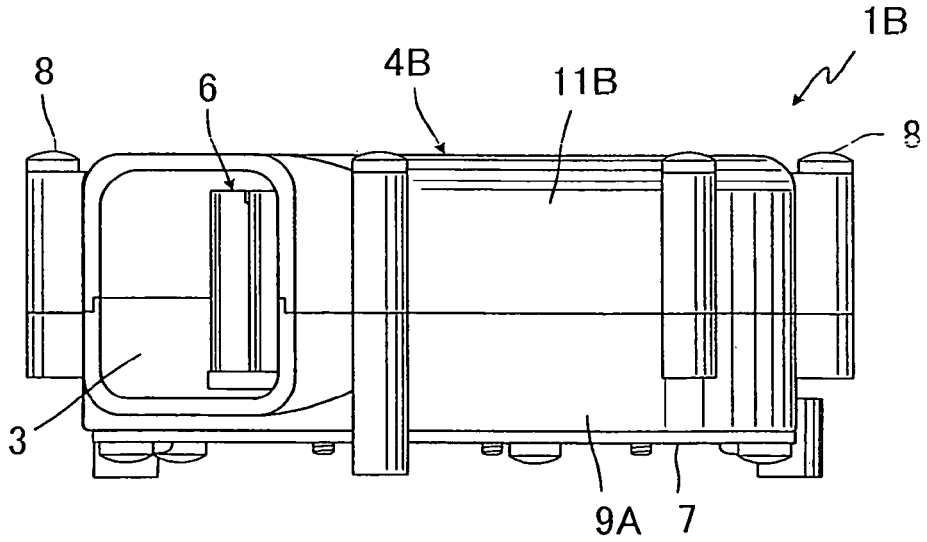
FIG. 16 is a front view showing a third embodiment of the present invention.
Figure 17:
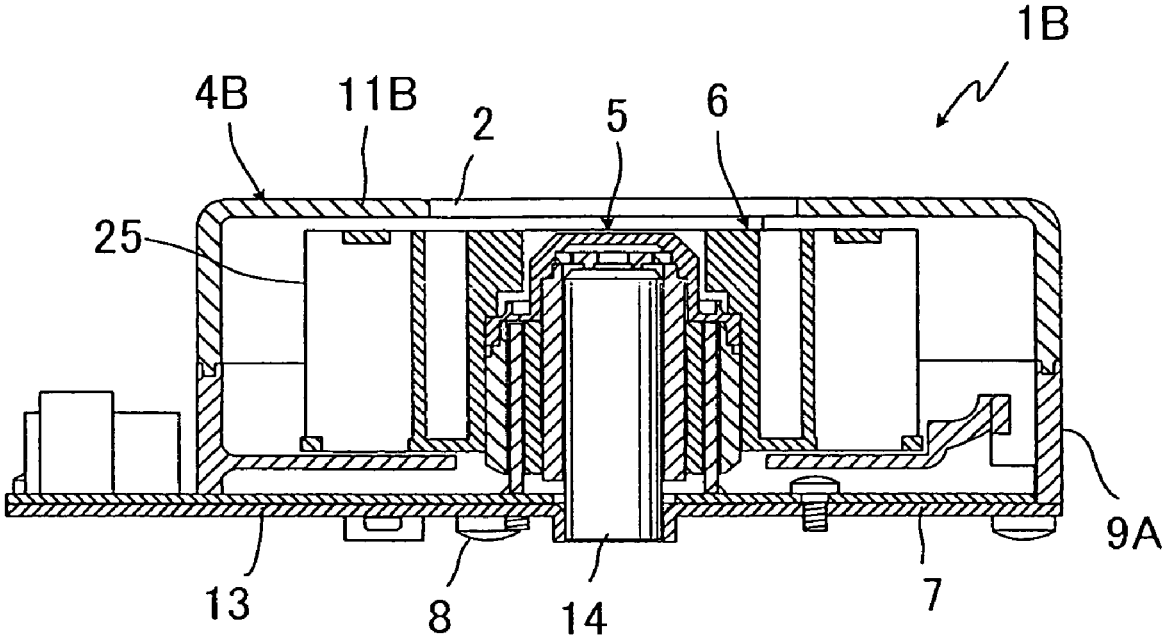
FIG. 17 is a cross sectional view taken along a line 17-17 in FIG. 15.

A third embodiment of the present invention is shown in FIGS. 15 to 17 and is distinguished from the first embodiment by the fact that the case body 4 is replaced from the case body 4B including an upper case 11B and the lower case 9 having the air suction mouth 2 which is formed at a center portion of the upper surface thereof. An air blower 1B with the case body 4B according to the third embodiment has similar advantages to that according to the first embodiment.

In addition, the ring blade support plates which are provided at upper and lower part of the impeller, equalizing the difference in pressure between the upper and lower portions, may include the plates which are attached each plate to the upper and lower surfaces respectively.

As set forth above, the advantages of the invention are as follows:

(1) The air blower includes a case body having an air suction mouth and an outlet formed at a peripheral wall thereof, a motor which is installed into the case body, having a fluid dynamic bearing; and an impeller which is fixed to a rotation member of the motor, having a plurality of blade support plates, which is formed in the shape of a ring, capable of suctioning air from the air suction mouth by rotating and discharging from the outlet, provided at an upper and lower surfaces thereof, equalizing the difference in pressure between the upper and lower surfaces thereof. Therefore, the impeller can be rotated by the motor with the fluid dynamic bearing.

Therefore, since the noncontact fluid dynamic bearing supports rotatably the impeller without the contacted bearing including the conventional ball bearing, sleeve bearing and oil retaining bearing, it can rotate at a high speed and blow in under high pressure at large air volume even though it is small size.

(2) As discussed above, the plurality of the blade support plates can equalize the difference in pressure between the upper and lower surfaces of the impeller.

Therefore, it can be prevented to move the impeller upward and downward impeller during rotating and prevented the contact resistance and wear during rotating, it can be economical and long-lived.

(3) As discussed above, it has a simple structure, and it is easy to manufacture.

(4) The coreless motor as the motor as discussed above is used so that it can reduce eddy-current loss and hysteresis loss.

(5) Also claim 2 has the same effect as the above (1) to (4).

(6) Also claim 3 has the same effect as the above (1) to (4), and it can reduce the manufacturing cost of the impeller and can be prevented to increase the cost.

INDUSTRIAL APPLICABILITY

The present invention is utilized in industry for the air blower.

What is claimed is:

1. An air blower comprising:

a case body having an air suction mouth and an outlet formed at a peripheral wall thereof;

a motor which is installed into the case body, having a non-contact fluid dynamic bearing, the motor being comprised of a base fixed to the case body, a shaft having a proximal end fixed to the base and a distal end of the shaft extending from the base, a sleeve arranged around an outer circumferential part of the shaft with a minute space between the sleeve and the shaft, the sleeve being rotatable around the shaft, a rotor with an arrangement of magnets fixed to an outer circumferential part of the sleeve, a coil attached to the base elate so as to be positioned around an outer circumferential part of the rotor, a rotation member, a concave part which forms an upper part of the rotation member the concave part covering the shaft and supporting the sleeve and the rotor, a first thrust magnet fixed to the concave part; and a second thrust magnet fixed to the distal end of the shaft so as to face to the first thrust magnet; and an impeller fixed to the rotation member of the motor, the impeller comprised of a plurality of blades and a plurality of annularly shaped blade support plates provided on an upper surface and a lower surface of the impeller in such manner as to permit equalization of a pressure difference between the upper surface and the lower surface of the impeller.

2. The air blower according to claim 1, wherein the plurality of annularly shaped blade support plates are comprised of a first lower blade support plate and a second lower blade support plate radially spaced apart along the lower surface of the impeller and an upper blade support plate provided on the upper surface of the impeller and having a radius between a radius of the first lower blade Support plate and a radius of the second lower blade support plate.

3. The air blower according to claims 1 or 2, wherein the ring blade support plates are positioned on the impeller in such manner that the impeller and the ring blade support plates may be formed integrally by a single mold.

4. The air blower according to claim 2, wherein the first lower blade support plate is provided on the lower surface of the impeller adjacent to an inner radius of the impeller, and the second lower blade support plate is provided on the lower surface of the impeller adjacent to an outer radius of the impeller.

* * * * *